US008454062B2

(12) United States Patent
Rohlfing et al.

(10) Patent No.: US 8,454,062 B2
(45) Date of Patent: Jun. 4, 2013

(54) HANDLE DEVICE

(75) Inventors: Manfred Rohlfing, Velbert (DE); Stefan Neuhoff, Essen (DE)

(73) Assignee: Huf Hulsbeck & Furst GmbH & Co., KG (DE)

( * ) Notice: Subject to any disclaimer, the term of this patent is extended or adjusted under 35 U.S.C. 154(b) by 1083 days.

(21) Appl. No.: 11/994,681

(22) PCT Filed: Jun. 27, 2006

(86) PCT No.: PCT/EP2006/063597

§ 371 (c)(1),
(2), (4) Date: Jun. 12, 2008

(87) PCT Pub. No.: WO2007/003534

PCT Pub. Date: Jan. 11, 2007

(65) Prior Publication Data

US 2008/0314097 A1 Dec. 25, 2008

(30) Foreign Application Priority Data

Jul. 4, 2005 (DE) ..... 10 2005 031 441

(51) Int. Cl.
*E05B 3/08* (2006.01)

(52) U.S. Cl.
USPC ..... 292/336.3; 340/5.72

(58) Field of Classification Search
USPC ..... 292/347, 336.3; 340/5.62, 426.28, 340/426.36, 530, 545.4, 5.72
See application file for complete search history.

(56) References Cited

U.S. PATENT DOCUMENTS

| | | | | |
|---|---|---|---|---|
| 6,128,933 | A * | 10/2000 | Mirshafiee et al. | 70/107 |
| 6,429,782 | B2 * | 8/2002 | Pavatich et al. | 340/686.6 |
| 6,527,316 | B1 * | 3/2003 | Agostini et al. | 292/347 |
| 6,740,834 | B2 * | 5/2004 | Sueyoshi et al. | 200/600 |
| 6,768,413 | B1 * | 7/2004 | Kemmann et al. | 340/5.72 |
| 6,933,831 | B2 * | 8/2005 | Ieda et al. | 340/5.72 |
| 7,091,823 | B2 * | 8/2006 | Ieda et al. | 340/5.72 |
| 7,210,715 | B2 * | 5/2007 | Kobayashi | 292/336.3 |
| 7,233,080 | B2 * | 6/2007 | Garnault et al. | 307/10.2 |
| 7,375,613 | B2 * | 5/2008 | Shelley et al. | 340/5.72 |
| 7,576,631 | B1 * | 8/2009 | Bingle et al. | 340/5.54 |
| 2002/0157436 | A1 * | 10/2002 | Klein | 70/257 |
| 2003/0122556 | A1 * | 7/2003 | Sueyoshi et al. | 324/686 |

FOREIGN PATENT DOCUMENTS

| | | |
|---|---|---|
| DE | 196 17 038 | 11/1997 |
| DE | 101 32 077 | 1/2003 |
| DE | 102 34 231 | 2/2004 |
| DE | 103 07 673 | 9/2004 |
| DE | 103 31 440 | 2/2005 |
| DE | 10 2004 061 092 | 2/2006 |

(Continued)

OTHER PUBLICATIONS

KR OA 10-2008-7002834 dated Aug. 6, 2012.

*Primary Examiner* — Gary Estremsky
(74) *Attorney, Agent, or Firm* — Cantor Colburn LLP

(57) ABSTRACT

The invention relates to a handle device for a vehicle door, comprising an outer shell with a metal layer at least on the side facing away from the vehicle door and a cavity in which a sensor system for the keyless activation of a locking and unlocking system is arranged. According to the invention, the outer shell (4) has a free surface (7) with no metal layer, provided with a first sensor element (6*a*) arranged in the sensor system (6*a*, 6*b*, 6*c*), which has a touch- or proximity-sensor embodiment.

24 Claims, 2 Drawing Sheets

FOREIGN PATENT DOCUMENTS

| | | |
|---|---|---|
| EP | 1 384 844 | 1/2004 |
| EP | 1 428 961 | 6/2004 |
| FR | 2 827 064 | 7/2001 |
| FR | 2 827 064 | 1/2003 |
| JP | 3566943 | 9/2004 |
| WO | 02/33203 | 4/2002 |
| WO | 03/012230 | 2/2003 |

* cited by examiner

HANDLE DEVICE

TECHNICAL FIELD OF THE INVENTION

The invention relates to a handle device for a vehicle door, comprising an outer shell with a metal layer at least on the side facing away from the vehicle door and a cavity in which a sensor system for the keyless activation of a locking and unlocking system is arranged. It is self-evident that the vehicle door can also be understood to mean a rear hatchback door or boot lid instead.

BRIEF DISCUSSION OF RELATED ART

To one skilled in the art, a plurality of keyless locking and unlocking systems are known. In DE 196 17 038 C2 a locking system for a motor vehicle is described, which is interrogated by a vehicle-sided control unit after triggering of a (capacitive) sensor by an operator-specific data carrier.

One possibility is based on the notion that the control unit concerned begins a data exchange with the data carrier and in this manner compares the data supplied by the data carrier with the identification data stored in the electrical control unit. An operator desiring entry therefore no longer needs to have a matching key to a locking cylinder. Rather, his operator-specific data carrier unlocks the motor vehicle concerned for him without a key (keyless entry).

In order to start the relevant data exchange or data interrogation between the control unit and the operator-specific data carrier, in DE 196 17 038 C2 a capacitive sensor is proposed, comprising at least one electrode, which is integrated in the handle device as a capacitive sensor, wherein a second electrode of the capacitive sensor is arranged in the area of the handle device on the door side as a component of the door-panel construction. By means of this type of configuration, an electric field is set up between the two aforementioned electrodes. The capacity of the capacitor formed in such a way between the two electrodes is liable to be changed by the dielectric of a human hand entering the region of the electric field, and therefor to be sensed. In other words a capacitor is provided by the two electrodes, on one side in the handle device, on the other in the door panel, the capacity of which is changed if a human hand is introduced between the two electrodes. Because due to this process the relative dielectric constant of the capacitor formed varies and thereby its capacity, which in turn can be measured and analysed for triggering the data interrogation.

Other examples of keyless locking and unlocking systems are disclosed in DE 103 31 440 A1, DE 103 07 673 A1 and also in DE 102 34 231 A1.

In order to facilitate a keyless locking of the vehicle door for the operator, in DE 196 17 038 C2 a second sensor fitted in the outer shell of the handle device is proposed. It has been shown that in handle devices having in particular a metal layer on their surface, which can serve as a decorative surface, interference can occur to the functioning. That means that in some application instances the sensor system positioned underneath the metal layer cannot be reliably activated, which is associated with a non-activation of the locking and unlocking system. This is not comprehensible to the operator concerned. This is where the invention intends to provide assistance.

BRIEF SUMMARY OF THE INVENTION

The problem addressed by the present invention is to produce a handle device for a vehicle door of a motor vehicle, in which the disadvantages cited are avoided, in particular a handle device is provided, which is simply constructed, can be assembled at relatively low cost and enables the user to open and lock all openings of the vehicle in a comfortable and safe manner via a locking and unlocking system.

Also provided according to the invention is that the outer shell has a free surface with no metal layer, provided with a first sensor element arranged in the sensor system, which has a touch- and/or proximity sensor embodiment. This means that the first sensor element is directed towards the free surface. It is particularly advantageous that the available free surface guarantees reliable functioning as regards the keyless activation of the locking and unlocking system via the sensor system, in particular via the first sensor element. The user can for example activate the first sensor element with their hand by approaching the free surface, by stroking over or touching the free surface (with or without application of pressure), by which action for example a closing process of the vehicle door is effected. In this embodiment of the invention the free surface simultaneously has the function of an activation surface, which in a possible construction form can be coloured in such a way that the operator unmistakably recognises this surface as an activation surface for a locking and unlocking system. It is conceivable for example to construct this free surface so as to be essentially the same size as a thumb. In this case, the operator takes hold of the handle device and at the same time touches the activation surface which is formed by the free surface. For design engineering reasons the rest of the outer shell can be fitted with a metal layer, without this affecting the functioning of the sensor systems, in particular of the first sensor element.

In one possible embodiment of the invention the sensor system is accommodated in a modular unit which completely surrounds the sensor system. This modular unit, which is preferably made from a plastic, simultaneously protects the sensor system from possible damage during installation in the handle device or during permanent operation. Advantageously, the first sensor element is connected to a printed circuit board, which is protectively embedded in the modular unit.

For reasons of expediency the modular unit extends into the cavity of the handle device and closes off the cavity at least on one side. The modular unit is a type of insertable container, in which the electronics of the sensor system is contained. The handle device, which is produced as an injection moulded part made from plastic, in particular by means of a gas-assisted forming process and preferably constructed with thin walls, has an opening on one side through which the modular unit is guided during the installation. An opening can also be embodied on the handle device on the opposite side, through which for example the sensor system exchanges data with the vehicle over data cables. The modular unit is preferably matched to the cavity contours, so that in the inserted state the outer walling of the modular unit are in contact with the inner walling of the cavity. The modular unit positioned inside the handle device can for example fill up only a part of the cavity or in a further configuration construction form of the invention essentially take up the volume of the entire cavity. It is particularly advantageous that the sensor system can be quickly inserted in an installation-friendly manner into the handle device, whereby at the same time the modular unit reliably closes off the cavity of the handle device on one side.

In a further alternative of the invention the free surface can be constructed in the form of a recess, which is embodied on the side of the vehicle door facing away from the outer shell. If the modular unit is inserted inside the cavity, at least one region of the modular unit remains freely accessible to the user. In a preferred alternative, the free surface is arranged on the side of the handle device facing away from the door, so that the modular unit on the recess is visible to the user. It is in this visible region, which is referred to in the following as an activation region, where in a preferred construction of the handle device the first sensor element is arranged. In this case the activation region, the shape of which is matched to the recess, is accommodated by the recess. That means that the contour of the recess is essentially adapted to that of the activation region. Especially advantageous is the fact that the modular unit also incorporates the activation region along with the sensor system, which simplifies the subject matter of the invention.

In a further possible construction of the handle device the surface of the activation region can be arranged to be flush with the outer shell. The first sensor element is for expediency purposes is positioned at a small distance from the surface of the activation region, whereby the first sensor element can be constructed as a capacitive sensor and/or a Hall sensor and/or a piezo-sensor. This means that the first sensor element can consist of either one or also of multiple sensors.

In an alternative embodiment it is conceivable to position the activation region in the recess below the surface. In this case the surface of the activation region is arranged in a recessed manner to the surface of the outer shell of the handle device. With this recessed positioning the first sensor element, if it takes the form of a touch sensor, is protected from unconscious and undesired operation on the part of the user.

In one possible embodiment the first sensor element can immediately effect a locking and unlocking process of the vehicle door by means of an appropriate activation. It is of course possible that a security check is introduced first of all, which examines whether the user is authorised to carry out a process of closing or opening of the vehicle door. Checking devices of this kind are described for example in DE 103 31 440 A1 or in DE 196 17 038 C2.

The capacitive sensor, which works as a proximity sensor, has an activation distance lower than 30 cm, preferably less than 15 cm, more preferably lower than 5 cm and particularly preferably lower than 1 cm. The deliberately low choice of activation distance has the purpose that activation of the capacitive sensor only occurs due to a conscious approach of the user's hand in the proximity of the activation surface. The essential component of the capacitive sensor is a capacitor, the capacity of which increases on the approach of an object (for example the operator's hand). This change can be used as a measurement reading for example of the distance of the object from the sensor. In this case, the capacity between a measurement electrode and an electrical earth can be measured. The earth can be formed by an electrode, by the sensor housing or by the environment. A set of electronics, which senses the change of the capacity and translates it into a command pulse, is preferably located in a space-saving manner within the handle device, in particular accommodated by the modular unit in the sensor system. The command pulse generated by this set of electronics can for example effect an immediate locking and unlocking of the vehicle doors. This command pulse can also trigger a process of checking to what extent the user is authorised to start an activation of the locking and unlocking system.

If in a further construction form of the handle device, the first sensor element is constructed as a piezo-sensor, an activation takes place via touching of the activation surface. The piezoelectric sensor, when stressed by a tensile force, compressive force or a shearing force, generates a displacement of its electrical charge and thereby an electrical voltage on the connecting electrodes. In this process only small forces are sufficient to start an activation of the locking and unlocking system via the piezo-sensor. Naturally, other types of sensors can also be used for this above mentioned application, for example those in the form of a Hall sensor.

In a further possible embodiment of the handle device, the outer shell can be constructed with a stop surface, which is in contact with the activation area. This stop surface can at the same time serve as an assembly aid, whereby the assembly operator notes the correct installation position (installation depth) of the modular unit within the handle device, when the modular unit contacts the stop surface. Alternatively or additionally latching elements can be constructed on the inner surface of the cavity, which ensure a reliable holding of the modular unit.

The sensor system preferably comprises a second sensor element facing the vehicle door, which is embodied for example as a capacitive sensor. This second sensor element can be constructed in such a way that it allows the authorised user access to the vehicle in a convenient and simple manner. In this process the user only needs to grasp the handle device with his hand, whereby the hand activates the second sensor element at the same time, causing a signal to be generated which is transmitted to an electrical control unit. The control unit triggers an access control procedure already described above. For expediency purposes the second sensor element is likewise connected to the printed circuit board, which is already in contact with the first sensor element.

The modular unit can be fixed to the outer shell with a positive fitting and/or a force fitting and/or a material connection. In one possible embodiment the modular unit is connected to the outer shell by means of a screw connection. If replacement of the modular unit is necessary, by undoing the screw connection the modular unit can be removed from the cavity of the handle device without great assembly effort. In a further conceivable alternative the modular unit can be laser-welded on to the outer shell.

A further advantageous configuration provides that a screening element is arranged in the modular unit in such a way that the first sensor element lies essentially between the surface of the activation region and the screening element. The screening element can be for example a plate-shaped body made from a metal, or a plastic foil with a metallic coating, or a metal foil. The screening element has the task, inter alia, of effectively preventing interference to the first sensor element due for example to the emergence of fields emitted by the second sensor element. The said screening element can assume a diverse range of three-dimensional shapes, for example it can be embodied in a planar form or be arranged in a bowl shape underneath the first sensor element.

In one possible embodiment the modular unit is constructed T-shaped on the side having the first sensor element and closes off the cavity at this point. This T-shaped head region of the modular unit is preferably arranged outside of the cavity and at the same times is in direct contact with the walling of the outer shell. The head region also comprises the activation region with the first sensor element, which is accommodated by the recess. Starting from the head region, a foot region extends through the opening of the cavity and at least partially fills this. In the foot region for example the printed circuit board with the second sensor element is accommodated. The foot region and the head region are preferably connected together to form a single part. A reliable fixing of the modular unit to the handle device can alternatively be achieved by the modular unit, which is fixed in a form-fit way in the cavity.

A further alternative of the invention provides that the sensor system is fixed in the cavity in such a way that the surface of the activation region is located inside the cavity and is in contact with the inner walling of the outer shell, wherein at the same time the free surface is arranged above the activation region on the outer walling of the outer shell. The activation region with the first sensor element is thus covered by the walls of the outer shell.

The above described locking function can also in the present invention comprise a convenient locking function, which effects an automatic locking of all vehicle doors and closing of all other open vehicle openings. Vehicle openings here mean in particular windows, sliding roofs and convertible tops. The convenient locking function can be started for example by a long pressure on the activation region.

The present handle device relates to diverse motor vehicle handles, for example pull handles, tilting handles or revolving handles.

BRIEF DESCRIPTION OF THE DRAWINGS

Further advantages, features and details of the invention follow from the following description, in which multiple exemplary embodiments of the invention are described with reference to the drawings. The features mentioned in these claims and description can be essential to the invention either respectively alone in themselves or in any arbitrary combination. It is shown in:

DETAILED DESCRIPTION OF THE INVENTION

Figure 1:
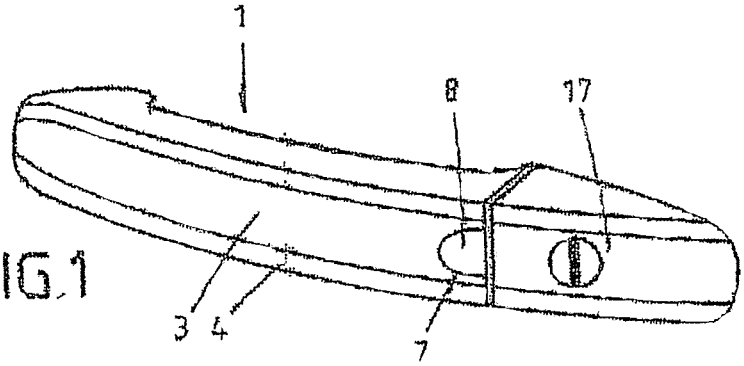
FIG. 1 a three-dimensional illustration of vehicle handle.
Figure 9:
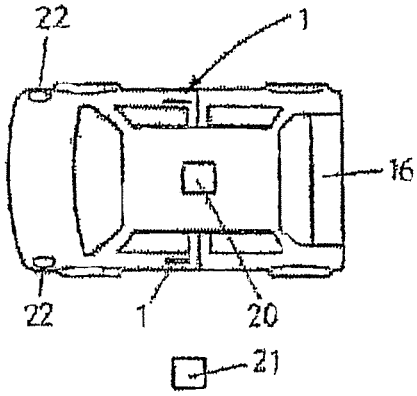

FIG. 1 shows a handle device 1, having a free surface 7 on its outer shell 4. The free surface 7 is constructed in the form of a recess, embodied on the outer shell 4. As FIG. 2 and in particular FIG. 3 clarify, the free surface 7 is embodied on the side of the handle device 1 facing away from the vehicle door 2. The outer shell 4 in the present exemplary embodiment is an injection-moulded part made of plastic, which has a cavity 5 in its interior. The thin-walled outer shell 4 has on the side facing away from the vehicle door 2 a metal layer 3, which in the exemplary embodiment illustrated is a chrome layer. The said chrome layer can have a thickness of 30 μm to 1 mm, preferably 100 μm to 800 μm and particularly preferably of 300 μm to 600 μm. The handle device 1 further comprises a sensor system 6*a*, 6*b*, 6*c* for the keyless activation of a locking and unlocking system, which is schematically illustrated in FIG. 9.

Figure 3:
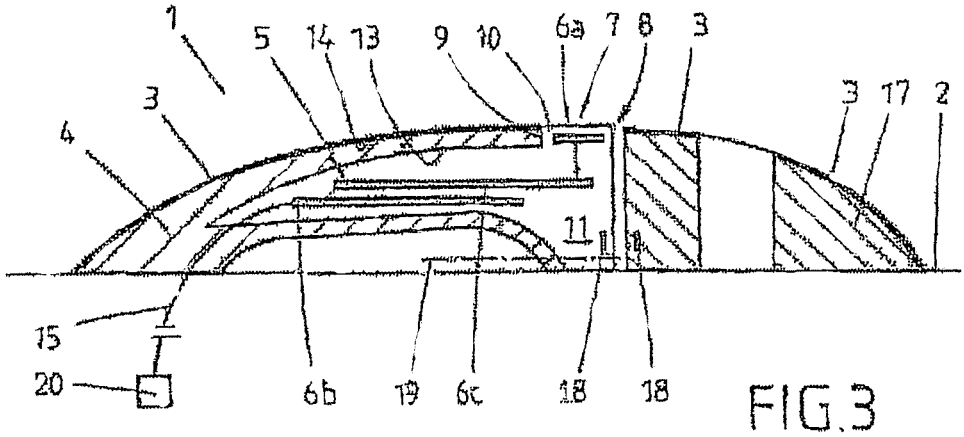
FIG. 3 a section view based on the section line III-III according to FIG. 2, FIG. 4 a possible embodiment of a handle device of a vehicle door with a modular unit having a screening element underneath the first sensor element, FIG. 5 a further construction of the handle device, FIG. 6 a further alternative construction of the handle device, FIG. 7 a handle device in which the modular unit is arranged completely inside the cavity, FIG. 8 an additional alternative of the handle device and FIG. 9 a simplified schematic illustration of the locking and unlocking system.

As FIG. 3 makes particularly clear, the sensor system 6*a*, 6*b*, 6*c* has a first sensor element 6*a*, which is directly assigned to the free surface 7. The sensor system 6*a*, 6*b*, 6*c* in the present exemplary embodiment is accommodated by a modular unit 11, which completely surrounds the sensor system 6*a*, 6*b*, 6*c*. The modular unit 11 has an activation region 8, in which the first sensor element 6*a* is arranged. The sensor element 6*a* in this arrangement is at a distance from the surface of the activation region 8 that can lie in a range between 0.5 mm and 2 mm. In the exemplary embodiment shown the first sensor element 6*a* is constructed as a capacitive sensor, which is connected to a printed circuit board 6*c*. The printed circuit board 6*c* is furthermore in contact with a second sensor element 6*b*, which is arranged on the side of the handle device 1 facing the vehicle door 2. This second sensor element 6*b* is also embodied as a capacitive sensor. The first sensor element 6*a* works as a type of point sensor, while the second sensor element 6*b* is constructed as an surface sensor. Naturally, both sensor elements 6*a*, 6*b* can be complemented or replaced by other sensor elements, for example piezo-sensors, Hall sensors or reed sensors.

According to FIG. 3 it is clear that the modular unit 11 extends with its foot region into the cavity 5 of the handle device 1 and the activation region 8 outside the cavity 5 is accommodated by the recess of the outer shell 4. The region of the modular unit 11 lying outside the cavity 5, which in the following will also be referred to as the head region, has a further sensor 18, which is a Hall sensor 18. The head region of the modular unit 11 is spaced apart from a locking cylinder part 17, which likewise comprises a Hall element 17 on the side facing the head region. The locking cylinder part 17 is further embodied by a locking cylinder, in which a key can be mechanically introduced, in order to manually trigger a locking or unlocking process at the vehicle door 2. The locking cylinder part 17 is likewise fitted with a chrome layer 3 on the side facing away from the vehicle door 2. The facing surfaces of the locking cylinder part 17 and of the head region of the modular unit 11 are by contrast constructed free of chrome. The distance between these two surfaces is in the present exemplary embodiment approx. 1 mm.

Figure 2:
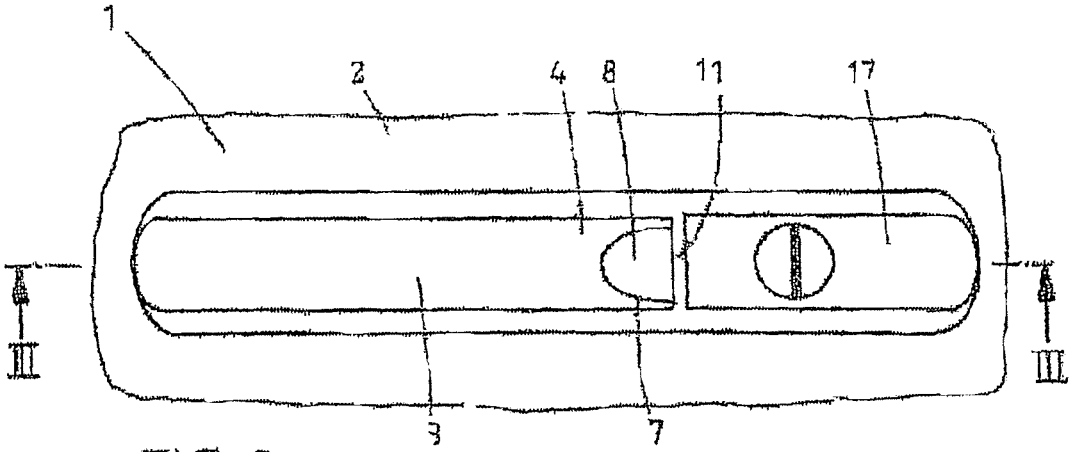
FIG. 2 a top view of the vehicle handle shown in FIG. 1.

As FIG. 3 makes clear, the modular unit 11 is constructed with a T-shape on the right-hand opening of the cavity 5, and closes off the cavity 5 on this right-hand opening side. In the lower region of the head region of the modular unit 11, this is connected to the outer shell 4 by means of a screw connection, which is indicated by the screw axis 19 shown in the drawing. Further alternative fixings of the modular unit 11 to the handle device 1 are of course conceivable. The outer shell 4 has constructed on its free surface 7 a stop surface 9, with which the activation region 8 is in direct contact. As shown in FIG. 2 and FIG. 3, the free surface 7 is arranged on the edge region of the handle device 1, the free surface 7 having an open embodiment on one side. So that the user can visually locate the activation region 8 without serious difficulty, the surface of the activation region 8 is constructed with appropriate colouring. For example, the surface of the activation region 8 can have a black colour, while the remaining outer region of the outer shell 4 has a silver-coloured chrome layer. The contour of the free surface 7 in the illustrated example corresponds essentially to the end of a thumb. Further alternative geometrical shapes of the free surface 7 are also possible.

In the present embodiment according to FIG. 3 the first sensor element 6*a* is provided only for a closing process of the motor vehicle door 2. The second sensor element 6*b* on the other hand is electronically installed for an opening process. If for example the hand of the user approaches the free surface 7, at a distance of approximately 1 cm the capacitive sensor in the activation region 8 is activated without touching, which causes a closing process of the locking and unlocking system of the motor vehicle to be carried out. The unlocking of the motor vehicle door 2 takes place in a manner whereby the user's hand must be introduced into the handle device 1 on the side of the outer shell 4 facing the vehicle door 2, so that the second sensor element 6*b* is activated by the piezo-effect, whereupon a signal is output to an electrical control unit 20, shown in FIG. 9. In the electrical control unit 20, which is integrated in the vehicle 16, such a signal triggers a data interrogation of a data carrier 21 on the operator side, which the electrical control unit 20 passes on to multiple sending and receiving units 22, which the data interrogation transfers electromagnetically to the data carrier 21. The data carrier 21 in this system is located with the user, wherein the data carrier 21 for example can be integrated in the key or is embodied as a type of chip card that the user carries on their person. The data carrier 21 also has sending and receiving units not shown, which then send identification data signals to the sending and receiving units 22 on the motor vehicle side, which are then fed to the control unit 20. If the transmitted identification data signals of the data carrier 21 correspond to the identification data stored in the control unit 20, unlocking of the door lock takes place by means of the control unit 20. Further details of this bidirectional communication of the electronic access control device are described in DE 103 31 440 A1 and in DE 301 196 17 038 C2.

So that a reliable functioning of the second sensor element 6*b* is guaranteed, the inner side of the handle device 1, which faces the vehicle door 2, is also embodied without a metallic coating. The control unit 20 in the present exemplary embodiment is connected to the sensor system 6*a*, 6*b*, 6*c* via conductor tracks 15. A wireless connection is of course also conceivable between these cited components. The cited sensor elements 6*a*, 6*b* can for example communicate with the control unit 20 over a radio link. In this case a BlueTooth-system based connection is also conceivable.

Figure 4:
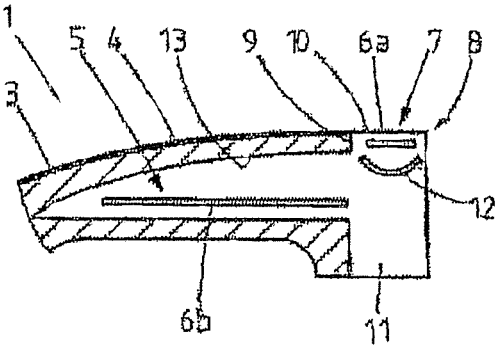

In FIG. 4 a further alternative form of the handle device 1 is shown according to FIGS. 1-3. The activation region 8 lying outside the cavity 5 has a screening element 12 underneath the first sensor element 6*a*, which consists of a plastic foil with a metallic coating. The screening element 12 is moulded in an oval shape, in such a way that the first sensor element 6*a* is effectively screened from possible electrical fields, which can arise for example due to the second sensor element 6*b*. The modular unit 11 has on the free end of its foot region, which faces away from the head region, data leads 15, which are connected to the control unit 20. As is clear from FIG. 4, the modular unit 11 only partially fills the cavity 5.

Figure 5:
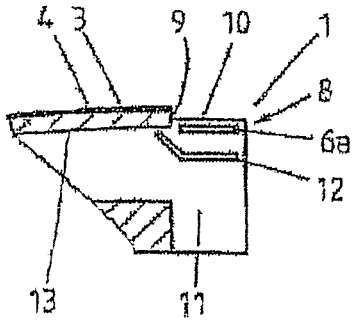
Figure 6:
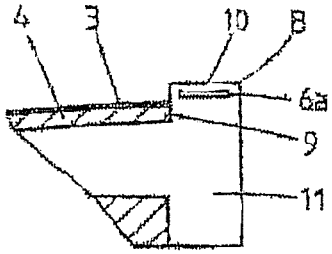

In FIG. 5 a partial section of the handle device 1 is illustrated, which essentially consists of the handle device 1 from FIGS. 1-4. The essential difference however is that the activation region 8 is positioned in the recess 7 below the surface. The screening element 12 in this embodiment has two wall elements, which are aligned at an obtuse angle to each other. In addition, the possibility also exists to construct the activation region 8 of the head region of the modular unit 11 so that it projects out of the outer surface of the handle device 1, which is shown schematically in FIG. 6.

Figure 7:
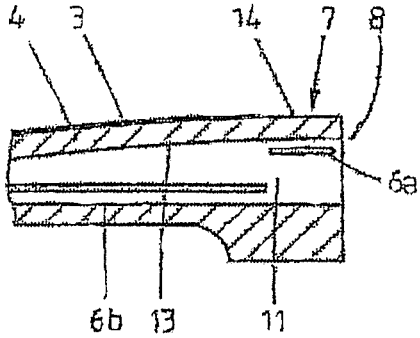

In a further conceivable alternative embodiment the modular unit 11 can be arranged in its entirety inside the cavity 5, an example of which is shown in FIG. 7. In the region of the opening of the cavity 5 the first sensor element 6*a* is arranged, which is arranged on the side of the vehicle door 2 facing away. The metal layer 3 is applied to the surface of the outer shell 4. The outer walling 14 directly above the first sensor element 6*a*—which simultaneously represents the free surface 7—is constructed without a metallic coating according to the invention, in order to guarantee a reliable functioning of the first sensor element 6*a*. On the side facing the vehicle door 2 the modular unit 11 has the second sensor element 6*b*, which is embodied as a type of surface sensor on the edge region of the modular unit 11. The modular unit 11 shown in FIG. 7 can be fixed for example by a laser welded joint to the inner walling 13 of the cavity 5. The modular unit 11 can be also fixed in a form-fit way in the cavity 5.

Figure 8:
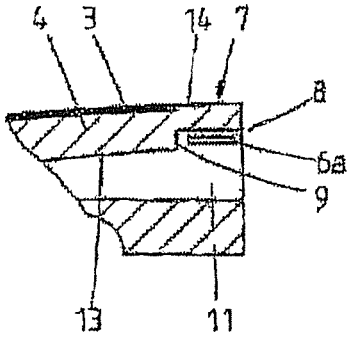

In FIG. 8 the modular unit 11 also lies, as in FIG. 7, completely inside the cavity 5, whereby the modular unit 11 is constructed with a comparable head region from the exemplary embodiments of FIGS. 1-6. The modular unit 11 is in this case essentially L-shaped, the activation region 8 being in contact with the first sensor element 6*a* on a stop surface 9 arranged inside the outer shell 4. The modular unit 11, in contrast to the other exemplary embodiments, has no second sensor element.

The handle devices 1 described can comprise sensor elements 6*a*, 6*b*, which can have touch- and/or proximity sensor embodiments.

The invention claimed is:

1. A handle device for a vehicle door, comprising:

an outer shell with a metal layer at least on a first side, said first side being positionable to face away from the vehicle door when the handle device is disposed on the vehicle door, and a cavity in which a sensor system for keyless activation of a locking and unlocking system is arranged, wherein the outer shell on said first side has a free surface with no metal layer, provided with a first sensor element arranged in the sensor system, which has a touch and/or proximity sensor embodiment, wherein the first sensor element is activatable by a user via at least one of approaching said free surface, stroking said free surface, and touching said free surface absent application of pressure by the user wherein, the sensor system has a second sensor element being positionable to face the vehicle door when the handle device is disposed on the vehicle door, wherein the second sensor element is a capacitive sensor.

2. The handle device according to claim 1, the sensor system is accommodated by a modular unit, which completely surrounds the sensor system.

3. The handle device according to claim 2, wherein, the modular unit extends into the cavity of the handle device and closes off the cavity at least on one side.

4. The handle device according to claim 2, wherein, the free surface is constructed in a form of a recess, which is embodied on the first side.

5. The handle device according to claim 4, wherein, the modular unit has an activation region, in which the first sensor element is arranged.

6. The handle device according to claim 5, wherein, the activation region, a shape of which is adapted to a shape of the recess, is accommodated by the recess.

7. The handle device according to claim 5, wherein, the outer shell is constructed with a stop surface, which is in contact with the activation region.

8. The handle device according to claim 1, wherein, the free surface is arranged on an edge region of the handle device, the free surface having an open embodiment on one side.

9. The handle device according to claim 1, wherein, the first sensor element comprises at least one of a capacitive sensor, a Hall sensor, and a piezo-sensor.

10. The handle device according to claim 5, wherein, the surface of the activation region is arranged to be flush with the outer shell.

11. The handle device according to claim 5, wherein, the activation region is positioned in a recess below the surface.

12. The handle device according to claim 1, wherein, the metal layer is a chrome layer.

13. The handle device according to claim 1, wherein, the metal layer has a thickness of 30 μm-1 mm.

14. The handle device according to claim 1, wherein, the sensor system has a printed circuit board, with which the first and the second sensor element are connected.

15. The handle device according to claim 2, wherein, the modular unit is fixed to the outer shell with one or more of a positive fitting, a force fitting and a material connection.

16. The handle device according to claim 14, wherein, the modular unit comprises of a plastic material, in which the first, the second sensor element and also the printed circuit board are embedded.

17. The handle device according to claim 5, wherein, a screening element is arranged in the modular unit in such a way that the first sensor element lies essentially between a surface of the activation region and the screening element.

18. The handle device according to claims 17, wherein, the screening element is a plate-shaped body made from a metal, or a plastic film with a metallic coating, or a metal foil.

19. The handle device according to claim 2, wherein, the modular unit is constructed T-shaped on a side having the first sensor element and closes off the cavity in this side.

20. The handle device according to claim 2, wherein, the modular unit is fixed in a form-fit way in the cavity.

21. The handle device according to one claim 1, wherein, an activation distance of the first sensor element constructed as a capacitive sensor is lower than 30 cm.

22. The handle device according to claim 5, wherein, the sensor system is fixed in the cavity in such a way that a surface of the activation region is located inside the cavity and is in contact with inner walling of the outer shell, wherein at the same time the free surface is arranged above the activation region on outer walling of the outer shell.

23. The handle device according to claim 1, further comprising, a locking cylinder part, which is fixed at a distance from the handle device on the vehicle door, wherein facing surfaces of the locking cylinder part and of the handle device are embodied without a metallic coating on their surfaces.

24. A motor vehicle with a handle device according to claim 1.

* * * * *